US009288581B2

(12) United States Patent
Miyata

(10) Patent No.: US 9,288,581 B2
(45) Date of Patent: Mar. 15, 2016

(54) SPEAKER UNIT

(71) Applicant: Sony Corporation, Tokyo (JP)

(72) Inventor: Kouji Miyata, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 14/390,464

(22) PCT Filed: Mar. 12, 2013

(86) PCT No.: PCT/JP2013/001589
§ 371 (c)(1),
(2) Date: Oct. 3, 2014

(87) PCT Pub. No.: WO2013/153741
PCT Pub. Date: Oct. 17, 2013

(65) Prior Publication Data

US 2015/0110337 A1 Apr. 23, 2015

(30) Foreign Application Priority Data

Apr. 11, 2012 (JP) ..... 2012-090520

(51) Int. Cl.
*H04R 1/00* (2006.01)
*H04R 9/02* (2006.01)
*H04R 9/06* (2006.01)

(52) U.S. Cl.
CPC ..... *H04R 9/027* (2013.01)

(58) Field of Classification Search
CPC ..... H04R 1/045; H04R 1/12; H04R 1/22; H04R 9/02; H04R 9/025; H04R 9/027; H04R 9/041; H04R 9/045; H04R 9/046; H04R 9/043; H04R 9/063; H04R 7/16; H04R 31/006; H04R 2400/03
USPC ..... 381/150, 396, 400, 412, 413, 415
See application file for complete search history.

(56) References Cited

U.S. PATENT DOCUMENTS 4,017,694 A * 4/1977 King ..... 381/415
4,675,907 A 6/1987 Itagaki et al.

(Continued)

FOREIGN PATENT DOCUMENTS

JP 57-208794 12/1982
JP 58-046798 3/1983

(Continued)

OTHER PUBLICATIONS

International Search Report corresponding to PCT/JP2013/001589, dated May 7, 2013, 2 pgs.

(Continued)

*Primary Examiner* — Brian Ensey
(74) *Attorney, Agent, or Firm* — Lerner, David, Littenberg, Krumholz & Mentlik, LLP

(57) ABSTRACT

[Object] To lower a mechanical resonance sharpness and reduce oscillations near a minimum resonance frequency, to thereby improve the sound quality.
[Solving Means] A speaker unit includes: a magnet that generates a magnetic force; a magnetic gap that causes the magnetic force to act; a yoke that is provided to be partially opposed to the magnet and forms a magnetic circuit that guides the magnetic force of the magnet to the magnetic gap; a coil bobbin that is formed in a tubular shape and is set to be axially vibratable with respect to the magnet and the yoke; a coil that is wound around the coil bobbin and partially placed in the magnetic gap; a cone that is vibrated in accordance with vibration of the coil bobbin; an edge that retains the cone at almost a center; and a frame that fixes each of the edge and the yoke, in which into the magnetic gap a magnetic fluid is injected, the magnetic fluid is set to have a viscosity equal to or larger than a predetermined value and a mechanical resonance sharpness is set to be equal to or smaller than 1.0, and sound proportional to a current is output by current drive.

5 Claims, 6 Drawing Sheets

2···Frame
12···Magnet
14···Magnetic gap
15···Coil bobbin
16···Coil
17···Magnetic fluid

(56) References Cited

U.S. PATENT DOCUMENTS

| | | | | |
|---|---|---|---|---|
| 5,335,287 | A * | 8/1994 | Athanas | 381/415 |
| 2001/0012372 | A1 * | 8/2001 | Yamagishi et al. | 381/349 |
| 2003/0025102 | A1 | 2/2003 | John et al. | |
| 2003/0194107 | A1 | 10/2003 | Tsuda et al. | |
| 2007/0036382 | A1 * | 2/2007 | Gladwin et al. | 381/338 |
| 2009/0257617 | A1 | 10/2009 | Ikeda et al. | |
| 2012/0106774 | A1 | 5/2012 | Saiki | |

FOREIGN PATENT DOCUMENTS

| | | | |
|---|---|---|---|
| JP | 61-018295 | | 1/1986 |
| JP | 61-021699 | | 1/1986 |
| JP | 2004-511094 | A | 4/2004 |
| WO | 2010/131404 | A1 | 11/2010 |

OTHER PUBLICATIONS

Extended European Search Report for EP Application No. 13776088.0, dated Oct. 29, 2015.

Japanese Office Action for JP Application No. 2014510033, dated Jan. 5, 2016.

* cited by examiner

1··· Speaker unit
2··· Frame
7··· Yoke
12··· Magnet
14··· Magnetic gap
15··· Coil bobbin
16··· Coil
17··· Magnetic fluid
18··· Cone 2··· Frame
12··· Magnet
14··· Magnetic gap
15··· Coil bobbin
16··· Coil
17··· Magnetic fluid 1A··· Speaker unit
2··· Frame
7··· Yoke
12··· Magnet
14··· Magnetic gap
15··· Coil bobbin
16··· Coil
17··· Magnetic fluid
18··· Cone
20··· Damper

SPEAKER UNIT

CROSS-REFERENCE TO RELATED APPLICATION

The present application is a national phase entry under 35 U.S.C. §371 of International Application No. PCT/JP2013/001589 filed Mar. 12, 2013, published on Oct. 17, 2013 as WO 2013/153741 A1, which claims priority from Japanese Patent Application No. JP 2012-090520 filed in the Japanese Patent Office on Apr. 11, 2012.

TECHNICAL FIELD

The present technology relates to a technical field of a speaker unit. More particularly, the present technology relates to a technical field of lowering a mechanical resonance sharpness and reducing oscillations at a frequency near a minimum resonance frequency, to thereby improve the sound quality of a speaker unit operated by current drive.

BACKGROUND ART

The speaker unit includes a so-called dynamic type speaker unit including, for example, a magnetic circuit constituted of a magnet, a yoke, and a coil (voice coil). In this dynamic type speaker unit, a coil bobbin wound with a coil is axially vibrated for outputting sound.

As this speaker unit, there is a type that is operated by voltage drive. The driving force for the speaker unit is proportional to the current. Therefore, in the case of the voltage-driven speaker unit, there is a fear that a linearity between the voltage and the driving force breaks down in various situations and the quality of sound output from the speaker unit is deteriorated.

For example, in the voltage-driven speaker unit, it becomes more difficult for the current to flow through the coil as the frequency domain becomes higher. Thus, the output is lower in a high-frequency domain.

By the way, a current-driven amplifier exists. When the speaker unit designed to be driven by the voltage is operated by this amplifier, a magnetic brake due to power generation of the coil is cancelled. Thus, large oscillations are generated due to spring vibration at a frequency near the minimum resonance frequency, which deteriorates the sound quality.

In view of this, there is a speaker unit that is adapted to reduce oscillations at the frequency near the minimum resonance frequency by attaching a resistance-adding seat such as a non-woven sheet that adds an air resistance to the back pressure.

However, in such a speaker unit, the number of parts is increased due to the provision of the seat, which causes a problem of deterioration of the outer appearance as well as an increased manufacturing cost and an additional working process of attaching the seat. Further, if the seat is separated, the function of reducing the oscillations is deteriorated.

From these perspectives, there is proposed a speaker unit in which a magnetic fluid having a viscosity that provides a suitable brake is injected into a magnetic gap formed between a magnet and a yoke (e.g., see Patent Documents 1 and 2).

PATENT DOCUMENT

Patent Document 1: Japanese Patent Application Laid-open Mo. SHO57-208794

Patent Document 2: Japanese Patent Application Laid-open No. SHO58-046798

SUMMARY OF INVENTION

Problem to be Solved by the Invention

In the speaker unit described in Patent Documents 1 and 2, the injection of the magnetic fluid having a viscosity that provides a suitable brake into the magnetic gap can reduce the oscillations. However, a sufficient effect of reducing the oscillations to improve the sound quality cannot be exhibited depending on the elasticity of a damper or an edge, the weight of the cone, and the viscosity value of the magnetic fluid.

For example, also in the case where the magnetic fluid is used, unless the sharpness (mechanical resonance sharpness and comprehensive resonance sharpness) being an index indicating a degree of convergence of the vibration is sufficiently low, it is impossible to sufficiently reduce the oscillations at the frequency near the minimum resonance frequency.

Therefore, it is an object of a speaker unit according to the present technology to overcome the above-mentioned problems and to lower a mechanical resonance sharpness and reduce oscillations at the frequency near the minimum resonance frequency, to thereby improve the sound quality.

Means for Solving the Problem

First, in order to solve the above-mentioned problems, a speaker unit includes: a magnet that generates a magnetic force; a magnetic gap that causes the magnetic force to act; a yoke that is provided to be partially opposed to the magnet and forms a magnetic circuit that guides the magnetic force of the magnet to the magnetic gap; a coil bobbin that is formed in a tubular shape and is set to be axially vibratable with respect to the magnet and the yoke; a coil that is wound around the coil bobbin and partially placed in the magnetic gap; a cone that is vibrated in accordance with vibration of the coil bobbin; an edge that retains the cone at almost a center; and a frame that fixes each of the edge and the yoke, in which into the magnetic gap a magnetic fluid is injected, the magnetic fluid is set to have a viscosity equal to or larger than a predetermined value and a mechanical resonance sharpness is set to be equal to or smaller than 1.0, and sound proportional to a current is output by current drive.

Thus, in the speaker unit, oscillations at a frequency near the minimum resonance frequency are reduced.

Second, the above-mentioned speaker unit is desirably used as a full range unit for an entire frequency band or a woofer for a low frequency band.

The speaker unit is used as the full range unit for the entire frequency band or the woofer for the low frequency band, and hence the reproduction area of the speaker unit surely includes the minimum resonance frequency.

Third, in the above-mentioned, speaker unit, the mechanical resonance sharpness is desirably set to be equal to or larger than 0.5 and equal to or smaller than 0.6.

The mechanical resonance sharpness is set to be equal to or larger than 0.5 and equal to or smaller than 0.6, and hence a good output state of the low frequency band is ensured, such that oscillations at the minimum resonance frequency are reduced.

Fourth, in the above-mentioned speaker unit, a damper having an elasticity that is coupled between a frame and the coil bobbin is desirably provided.

The damper having the elasticity that is coupled between the frame and the coil bobbin is provided, and hence the damper prevents the coil bobbin from being largely axially vibrated.

Fifth, in the above-mentioned speaker unit, for the magnetic fluid a material containing an oxide iron in a synthetic ester is desirably used.

For the magnetic fluid the material containing the oxide iron in the synthetic ester is used, and hence a material favorable as a material for lowering the mechanical resonance sharpness is used for the magnetic fluid.

Effect of the Invention

A speaker unit according to the present technology includes: a magnet that generates a magnetic force; a magnetic gap that causes the magnetic force to act; a yoke that is provided to be partially opposed to the magnet and forms a magnetic circuit that guides the magnetic force of the magnet to the magnetic gap; a coil bobbin that is formed in a tubular shape and is set to be axially vitaratable with respect to the magnet and the yoke; a coil that is wound around the coil bobbin and partially placed in the magnetic gap; a cone that is vibrated in accordance with vibration of the coil bobbin; an edge that retains the cone at almost a center; and a frame that fixes each of the edge and the yoke, in which into the magnetic gap a magnetic fluid is injected, the magnetic fluid is set to have a viscosity equal to or larger than a predetermined value and a mechanical resonance sharpness is set to be equal to or smaller than 1.0, and sound proportional to a current is output by current drive.

Thus, the oscillations at the minimum resonance frequency can be sufficiently reduced and the sound quality can be improved.

The technology described in claim 2 is used as a full range unit for an entire frequency band or a woofer for a low frequency band.

Thus, the reproduction area of the speaker unit surely includes the minimum resonance frequency and it is possible to reliably reduce oscillations at this minimum resonance frequency and to improve the sound quality of the low frequency band.

In the technology described in claim 3, in which the mechanical resonance sharpness is set to be equal to or larger than 0.5 and equal to or smaller than 0.6.

Thus, a good output state of the low frequency band is ensured, such that the oscillations at the minimum resonance frequency are sufficiently reduced and the sound quality can be further improved.

In the technology described in claim 4, a damper having an elasticity that is coupled between a frame and the coil bobbin is provided.

Thus, a high output in the reproduction area can be ensured.

In the technology described in claim 5, for the magnetic fluid a material containing an oxide iron in a synthetic ester is used.

Thus, it is possible to improve the sound quality without increasing the manufacturing cost of the speaker unit.

MODE(S) FOR CARRYING OUT THE INVENTION

Hereinafter, a best mode for carrying out a speaker unit according to the present technology will be described with reference to the attached drawings.

In the following description, upper, lower, front, rear, left-hand, and right-hand directions are shown, assumed that a direction in which the speaker unit is oriented is the front direction.

Note that the upper, lower, front, rear, left-hand, and right-hand directions described hereinafter are shown for the sake of description and the present technology is not applied limiting these directions.

[Entire Configuration]

Figure 1:
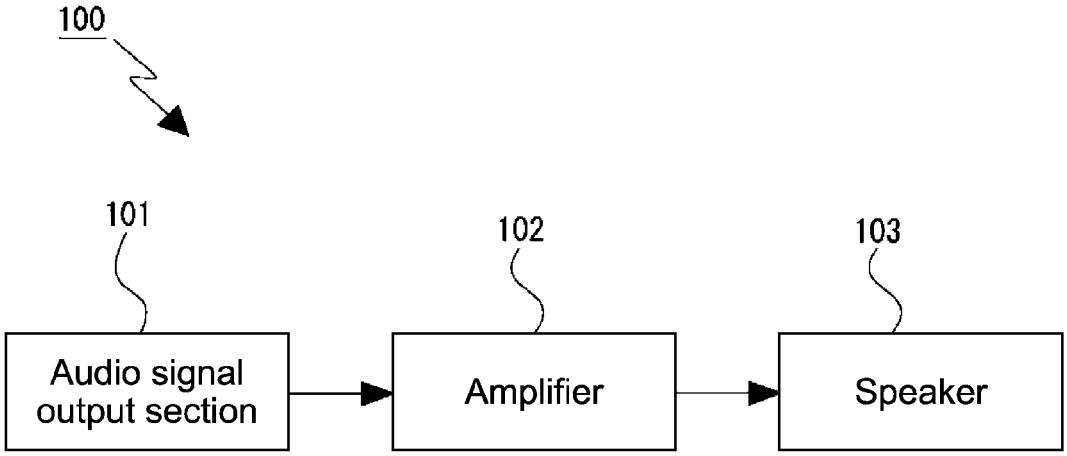
FIG. 1 A block diagram of a speaker system, which shows an embodiment of the present technology in conjunction with FIGS. 2 to 6.

First, an entire configuration of a speaker system in which a speaker unit is used will be described (see FIG. 1).

The speaker system 100 includes, for example, a sound signal output unit 101 such as a digital music player (DMP) and a disk player, an amplifier 102 that amplifies a sound signal output from the sound signal output unit 101 by current drive, and a speaker 103 that outputs sound. The amplifier 102 may include a built-in volume unit for volume control.

The sound signal output from the sound signal output unit 101 is an analog signal. The sound signal is amplified by the amplifier 102 and output from the speaker 103 as sound. Sound proportional to the current is output by current drive in the speaker 103.

The speaker 103 is constituted of an enclosure (casing) and a speaker unit 1. Note that various types including a hermetically closed type, a bass-reflex type, a back-loaded horn type, an acoustic pipe type, and the like are used as an enclosure.

[Specific Configuration of Speaker Unit]

Figure 2:
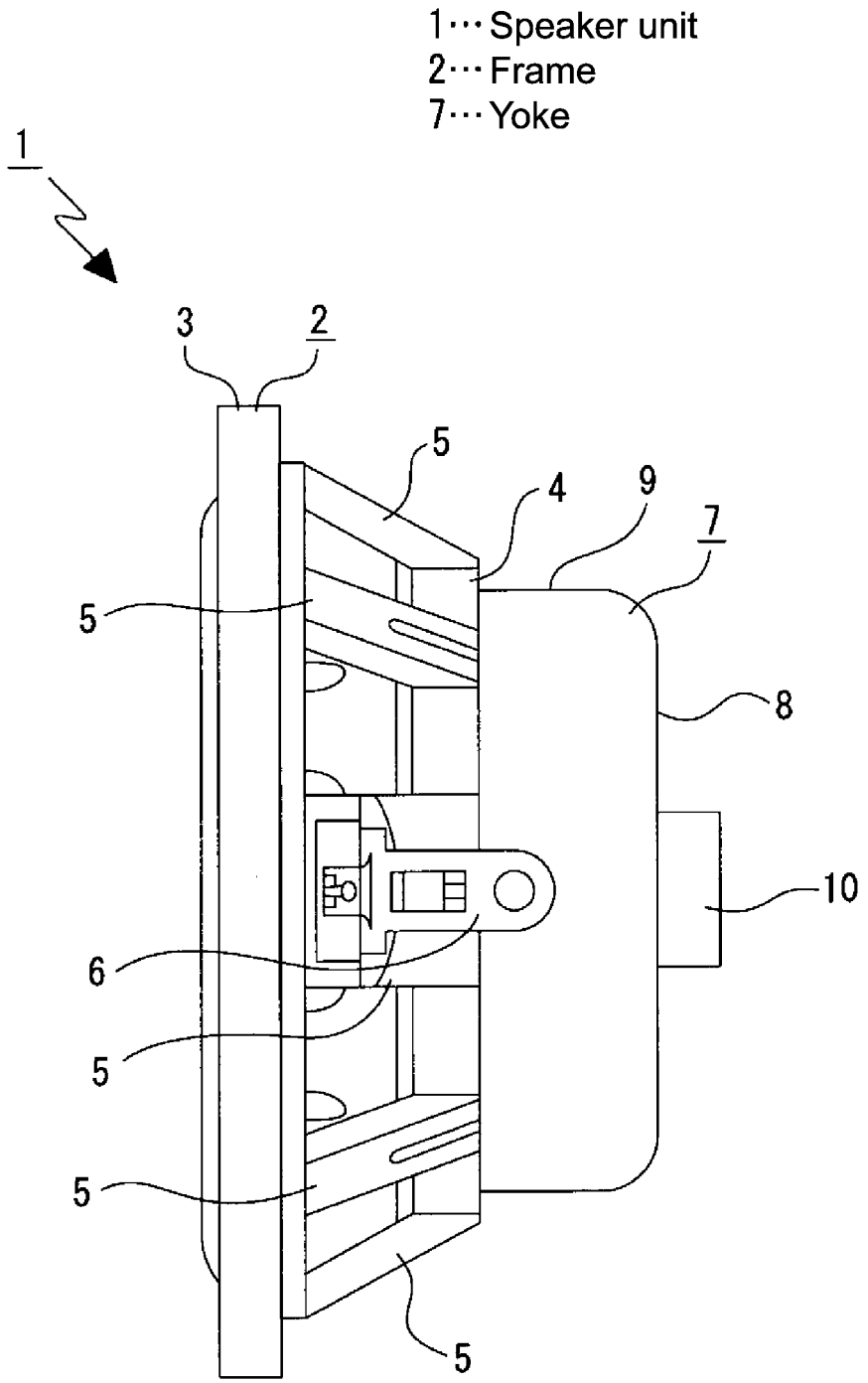
FIG. 2 A side view of the speaker unit.
Figure 3:
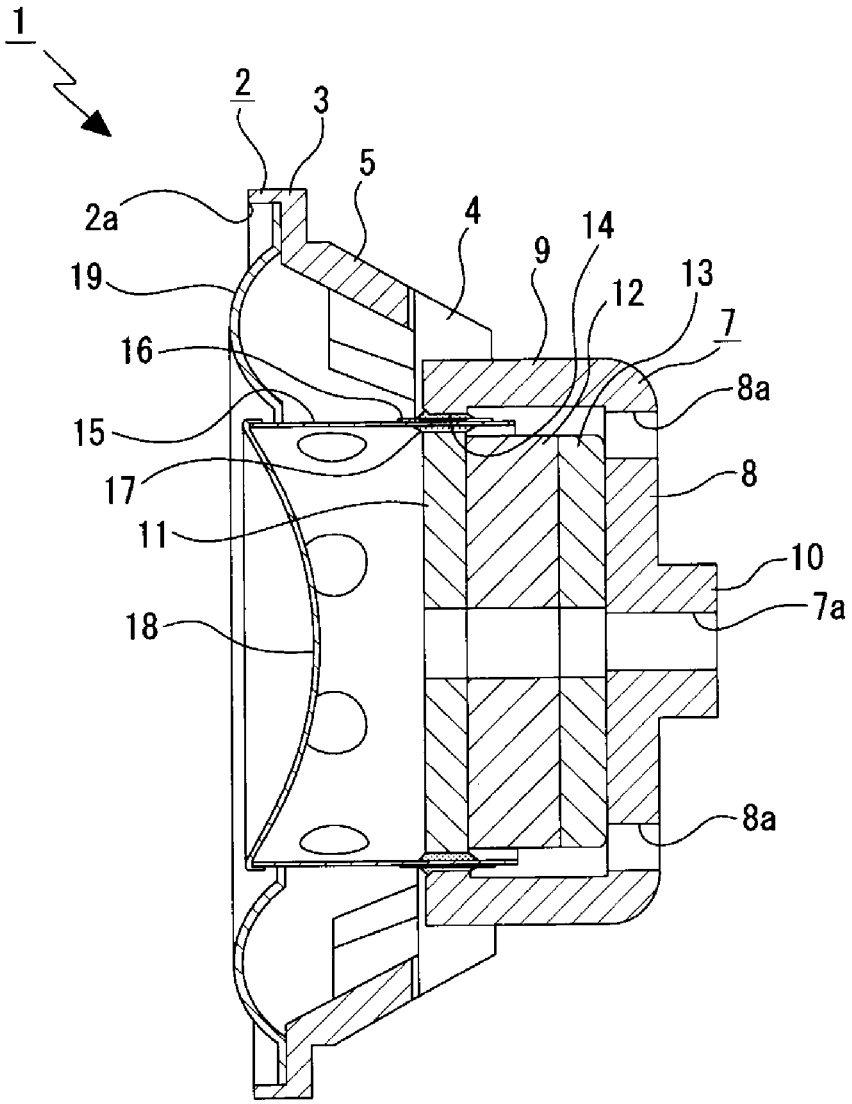
FIG. 3 A cross-sectional view of the speaker unit.

The speaker unit 1 is constituted of necessary parts inside or outside the frame 3 (see FIGS. 2 and 3).

The frame 2 includes a distal-end peripheral portion 3 formed in an almost annular shape, a base-end peripheral portion 4 located in the back of the distal-end peripheral portion 3 and formed in an almost annular shape, and coupling leg portions 5, 5, . . . that couple the distal-end peripheral portion 3 with the base-end peripheral portion 4.

The base-end peripheral portion 4 has a diameter smaller than the distal-end peripheral portion 3. The coupling leg portions 5, 5, . . . are tilted to be displaced outwards as it goes forward. A front opening of the distal-end peripheral portion 3 is formed as an opening 3*a* opened in the front direction, that is, a sound-outputting direction.

The coupling leg portions 5 are attached to a terminal 6. The terminal 6 is provided as a terminal portion to be connected to the amplifier 102.

A yoke 7 is provided on a rear end side of the frame 2. The yoke 7 is fixed to a rear end portion of the frame 2 and rearwardly projected from the frame 2 except for the front end portion.

The yoke 7 is constituted of a base surface portion 8 having an almost disk shape, an insertion positioning portion 3 having an almost cylindrical shape and frontwardly projected from an outer peripheral portion of the base surface portion 8, and a projection 10 rearwardly projected from a center portion of the base surface portion 8. The base surface portion 8, the insertion positioning portion 9, and the projection 10 are integrally formed. A through-hole 7*a* passing through the base surface portion 8 and the projection 10 is formed in the yoke 7.

Holes 8*a*, 8*a*, . . . are formed in an outer peripheral portion of the base surface portion 8 to be spaced apart from one another in a peripheral direction.

Inside the yoke 7, a first plate 11, a magnet 12, and a second plate 13 are arranged and fixed in a contact state in the stated order from the front. All of the first plate 11, the magnet 12, and the second plate 13 are formed in, for example, an annular shape. A rear surface of the second plate 13 is fixed to a front surface of the base surface portion 8 of the yoke 7.

A center axis of the yoke 7 corresponds to each of center axes of the first plate 11, the magnet 12, and the second plate 13. A space between an inner peripheral surface of the insertion positioning portion 9 and outer peripheral surfaces of the first plate 11, the magnet 12, and the second plate 13 is formed as a magnetic gap 14 that causes a magnetic force generated from the magnet 12 to act on a coil to be described later.

A coil bobbin 15 having a cylindrical shape is provided inside the frame 2. The coil bobbin 15 has a rear end portion placed in the magnetic gap 14. The coil bobbin 15 is set to be vibratable (movable) axially (in front and rear directions) with respect to the yoke 7, the first plate 11, the magnet 12, and the second plate 13.

The outer peripheral surface of the rear end portion of the coil bobbin 15 is wound with a coil (voice coil) 16. Both wounded end portions of the coil 16 are drawn out and connected to the terminal 6. The coil 16 is placed in the magnetic gap 14.

The coil 16 is placed in the magnetic gap 14, and hence the first plate 11, the magnet 12, the second plate 13, the yoke 7, and the coil 16 constitute a magnetic circuit.

Figure 4:
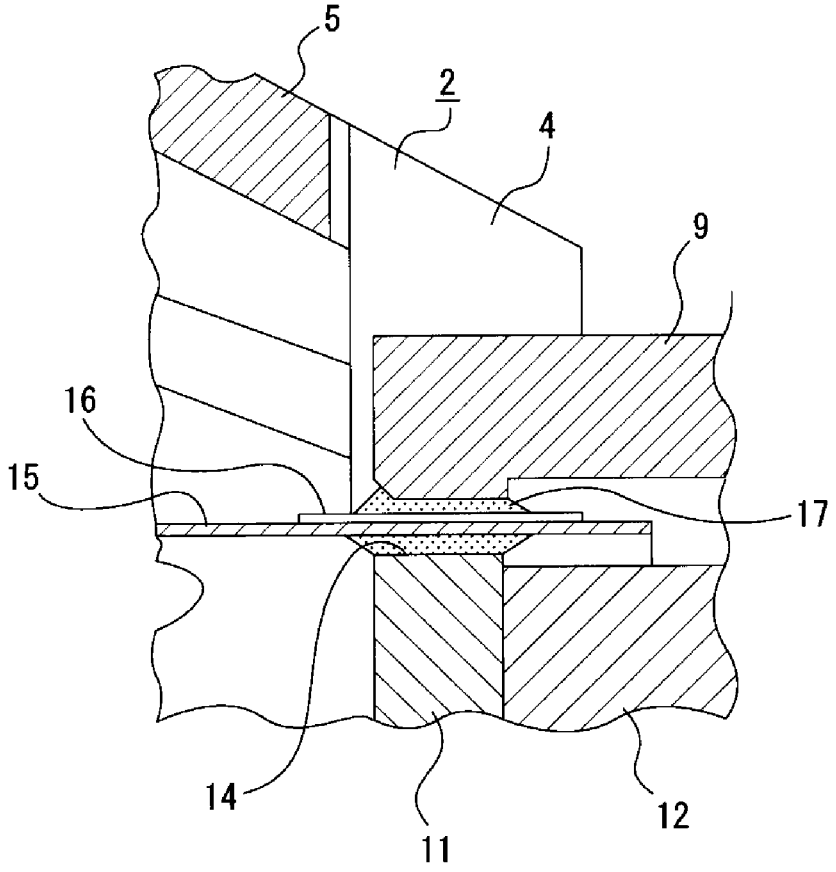
FIG. 4 An enlarged cross-sectional view showing an injection state of a magnetic fluid into a magnetic gap.

A magnetic fluid 17 is injected between the first plate 11 and a front end portion of the insertion positioning portion 9 of the yoke 7 (see FIGS. 3 and 4). The magnetic fluid 17 is retained between the first plate 11 and a front end portion of the insertion positioning portion 9.

For example, a material containing an iron oxide in a synthetic ester is used for the magnetic fluid 17 and formed in a colloidal state having a high viscosity. Note that the magnetic fluid 17 is not limited to a material containing an iron oxide in a synthetic ester and another material may be used for the magnetic fluid 17.

Note that a material that is not dispersed in accordance with vibrations during driving of the speaker unit 1 and is not solidified depending on the temperature or the like when used but has a high thermal resistance and a high magnetic flux density is desirably used for the magnetic fluid 17. From this perspective, the above-mentioned material containing an iron oxide in a synthetic ester is a favorable material as the material used for the magnetic fluid 17.

A cone 18 is attached to a front end portion of the coil bobbin 15. The cone 18 is vibrated in accordance with axial vibration of the coil bobbin 15.

An edge 19 formed in an annular shape is coupled between the front end portion of the coil bobbin 15 and the distal-end peripheral portion 3 of the frame 2. The edge 19 retains the cone 18 at almost the center and is vibrated in accordance with axial vibration of the coil bobbin 15.

As described above, the magnetic fluid 17 is injected into the speaker unit 1 and the magnetic fluid 17 has a function of centering the coil bobbin 15. Thus, the speaker unit 1 does not need to be provided with the damper.

The speaker unit 1 is not provided with the damper, and hence the number of parts is correspondingly reduced and the manufacturing cost of the speaker unit 1 can be reduced.

[Operation of Speaker Unit]

In the thus configured speaker unit 1, the coil 16 is supplied with a driving current. Then, a thrust force is generated in the magnetic circuit. The coil bobbin 15 is vibrated in the front and rear directions (axially). The cone 18 and the edge 19 are vibrated in accordance with the vibration of the coil bobbin 15. At this time, sound proportional to the current is output. In other words, sound output from the sound signal output unit 101 and amplified by the amplifier 102 is output.

[Sharpness]

In the speaker unit 1, as described above, the magnetic fluid 1 is set to have a high viscosity and a mechanical resonance sharpness Qms is made equal to or smaller than 1.0. A mechanical resonance sharpness Qms is an indicator indicating a degree of convergence of the vibration together with an electrical resonance sharpness Qes and a comprehensive resonance sharpness Qts. As a value becomes smaller, oscillations at a frequency near a minimum resonance frequency F0 are reduced.

The comprehensive resonance sharpness Qts is expressed by the following equation.

$$Qts=(Qms*Qes)/(Qms+Qes)$$

Figure 5:
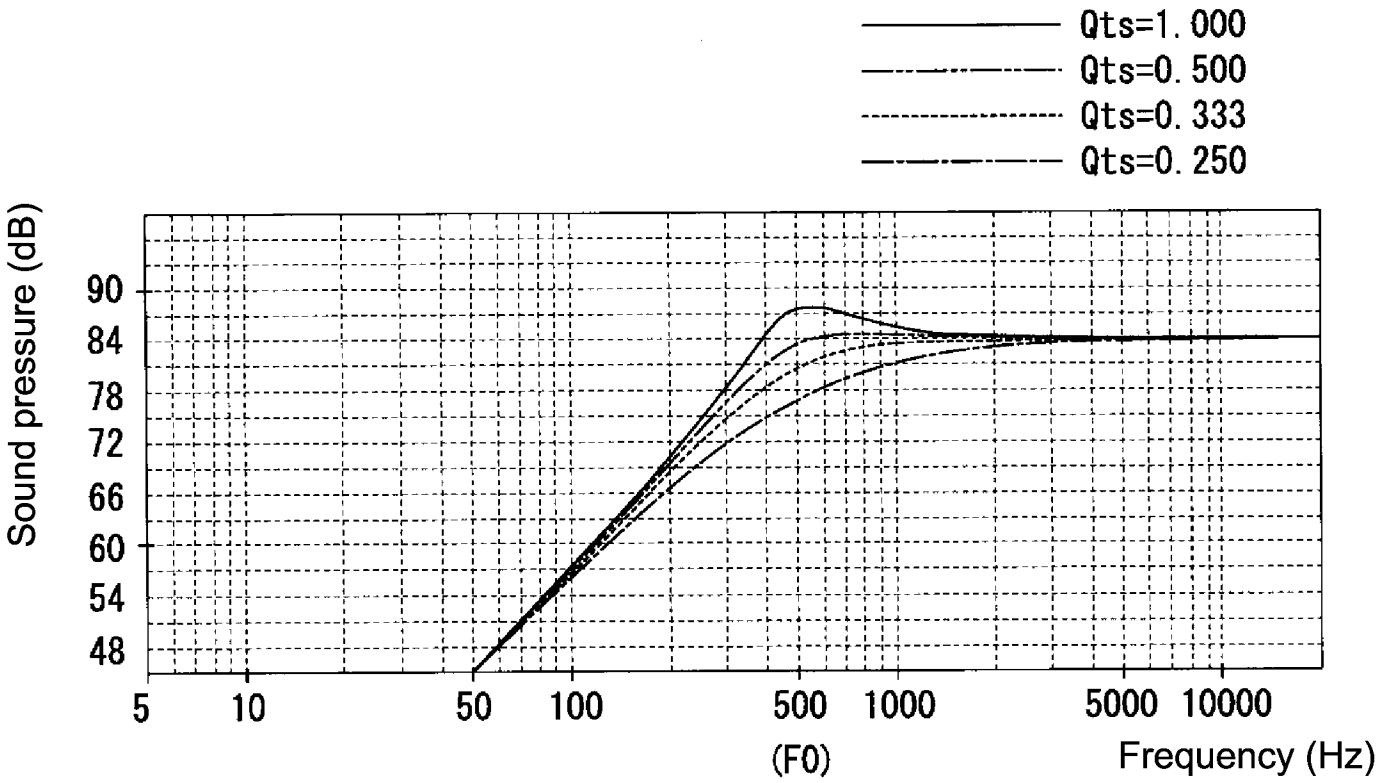
FIG. 5 A graph showing reproduction characteristics at a low frequency band due to a comprehensive resonance sharpness of the speaker unit.

FIG. 5 is a graph showing reproduction characteristics of a low frequency band due to the comprehensive resonance sharpness Qts of the speaker unit.

As shown in FIG. 5, as the value of the comprehensive resonance sharpness Qts becomes larger, a peak of the minimum resonance frequency F0 (about 500 Hz) becomes higher and it becomes easy for the oscillations to be generated. In contrast, as the value of the comprehensive resonance sharpness Qts becomes smaller, a peak of the minimum resonance frequency F0 becomes lower and it becomes difficult for the oscillations to be generated. In this case, however, the reproduction capability is lowered. Therefore, it is necessary to lower a peak of oscillations at a frequency near the minimum resonance frequency F0 and to keep balance for ensuring a good reproduction capability.

If a magnetic fluid having a high viscosity is used in a voltage-driven speaker unit such as a full range unit for an entire frequency band and a woofer for a low frequency band where the minimum resonance frequency F0 is present in a reproduction area, then, due to an action of a magnetic brake, which is generated in proportion to the speed of the coil (coil bobbin), which is expressed by the electrical resonance sharpness Qes, the comprehensive resonance sharpness Qts of the speaker unit becomes too small and a low frequency sound reproduction capability is deteriorated.

Thus, in the voltage-driven speaker unit such as a full range unit and a woofer where the minimum resonance frequency F0 is present in the reproduction area, the mechanical resonance sharpness Qms is generally adjusted not to be smaller by lowering the viscosity of the magnetic fluid.

However, in the speaker unit 1, the action of the magnetic brake, which is generated in proportion to the speed of the coil (coil bobbin) is cancelled because it is operated by the current drive. As a result, the electrical resonance sharpness Qes takes an excessively large value. Therefore, the electrical resonance sharpness Qes is excessively larger than the mechanical resonance sharpness Qms.

As for the comprehensive resonance sharpness Qts, Qms/Qes is almost 0 from the following equation.

$$Qts=(Qms*Qes)/(Qms+Qes)=(Qms)/(Qms/Qes+1)$$

Thus, the comprehensive resonance sharpness Qts becomes almost equal to the mechanical resonance sharpness Qms.

Thus, in the speaker unit 1 operated by the current drive, the electrical resonance sharpness Qes can be ignored in the comprehensive resonance sharpness Qts and the comprehensive resonance sharpness Qts takes a value defined only by the mechanical resonance sharpness Qms.

Therefore, in the speaker unit 1, as described above, by setting the viscosity of the magnetic fluid 17 to be high, the mechanical resonance sharpness Qms is appropriately adjusted to be equal to or lower than 1.0, the comprehensive resonance sharpness Qts is controlled, and good reproduction characteristics of the low frequency band are ensured, such that the oscillations at the frequency near the minimum resonance frequency F0 can be sufficiently reduced.

Note that, in the speaker unit 1, the mechanical resonance sharpness Qms is desirably set to be equal to or larger than 0.5 and equal to or smaller than 0.6.

By setting the mechanical resonance sharpness Qms to be equal to or larger than 0.5 and equal to or smaller than 0.6, a good output state of the low frequency band is ensured, such that the oscillations at the minimum resonance frequency F0 are sufficiently reduced and the sound quality can be further improved.

[Modified Example of Speaker Unit]

Figure 6:
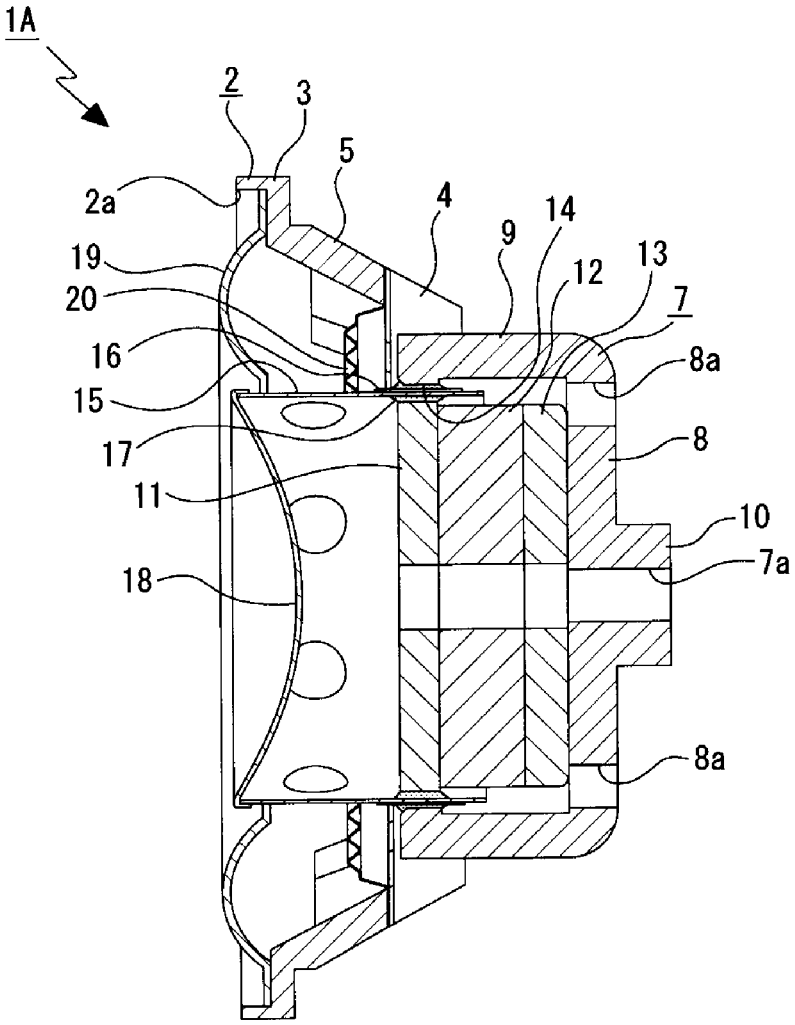
FIG. 6 A cross-sectional view of a speaker unit according to a modified example.

Hereinafter, a speaker unit 1A according to a modified example will be described (see FIG. 6).

Note that the speaker unit 1A shown hereinafter is different from the above-mentioned speaker unit 1 only in that the damper is provided. Therefore, in the following description of the speaker unit 1A, only portions different from those of the speaker unit 1 will foe described in details and the other portions will be denoted by the same reference symbols as those of the speaker unit 1 and descriptions thereof will be omitted.

A axial middle portion of the coil bobbin 15 of the speaker unit 1A is provided with a damper 20. The damper 20 is formed in an almost annular thin shape and set to be elastically deformable. An inner peripheral portion thereof is attached to the outer peripheral surface of the coil bobbin 15 and an outer peripheral portion is attached to the frame 2. The damper 20 is elastically deformed when the coil 16 is supplied with a driving current and the coil bobbin 15 is axially vibrated. The damper 20 has a function of preventing the coil bobbin 15 from being largely axially vibrated.

When the damper 20 is provided as in the speaker unit 1A, spring vibrations easily becomes large, and hence it is necessary to sufficiently reduce the oscillations at the frequency near the minimum resonance frequency F0 by adjusting the viscosity of the magnetic fluid 17. Thus, it is possible to ensure a high output in the reproduction range.

CONCLUSION

As described above, in each of the speaker units 1 and 1A, the magnetic fluid 17 is injected into the magnetic gap 14, the viscosity of the magnetic fluid 17 is set to be equal to or larger than a predetermined value, and the mechanical resonance sharpness Qms is set to be equal to or smaller than 1.0.

Thus, the oscillations at the frequency near the minimum resonance frequency F0 can be sufficiently reduced and the sound quality can be improved.

Further, by using the speaker units 1 and 1A as a full range unit for an entire frequency band or a woofer for a low frequency band, the reproduction area of each of the speaker units 1 and 1A surely includes the minimum resonance frequency F0. The oscillations at this minimum resonance frequency F0 can be reliably reduced and the quality of sound of the low frequency band can be improved.

In addition, the material containing an iron oxide in a synthetic ester is used as the magnetic fluid 17, and hence this material is favorable as the material for lowering the mechanical resonance sharpness Qms and also the adjustment of the viscosity is relatively easy. Thus, it is possible to improve the sound quality without increasing the manufacturing cost of each of the speaker units 1 and 1A.

[Present Technology]

The present technology may employ the following configurations.

(1) A speaker unit, including:

a magnet that generates a magnetic force;

a magnetic gap that causes the magnetic force to act;

a yoke that, is provided to be partially opposed to the magnet and forms a magnetic circuit that guides the magnetic force of the magnet to the magnetic gap;

a coil bobbin that is formed in a tubular shape and is set to be axially vibratable with respect to the magnet and the yoke;

a coil that, is wound around the coil bobbin and partially placed in the magnetic gap;

a cone that is vibrated in accordance with vibration of the coil bobbin;

an edge that retains the cone at almost a center; and a frame that fixes each of the edge and the yoke, in which into the magnetic gap a magnetic fluid is injected, the magnetic fluid is set to have a viscosity equal to or larger than a predetermined value and a mechanical resonance sharpness is set to be equal to or smaller than 1.0, and sound proportional to a current is output by current drive.

(2) The speaker unit according to (1), which is used as a full range unit for an entire frequency band or a woofer for a low frequency band.

(3) The speaker unit according to (1) or (2), in which the mechanical resonance sharpness is set to be equal to or larger than 0.5 and equal to or smaller than 0.6.

(4) The speaker unit according to any one of (1) to (3), in which a damper having an elasticity that is coupled between a frame and the coil bobbin is provided.

(5) The speaker unit according to any one of (1) to (4), in which for the magnetic fluid a material containing an oxide iron in a synthetic ester is used.

Any specific shapes and structures of the parts described in the above-mentioned best mode are merely examples of the realization when the present technology is carried out and it should, not be understood that these limit the technical range of the present technology.

DESCRIPTION OF SYMBOLS

1 speaker unit
2 frame
7 yoke
12 magnet
14 magnetic gap
15 coil bobbin
16 coil
17 magnetic fluid
18 cone
1A speaker unit
20 damper

The invention claimed is:

1. A speaker unit, comprising:

a magnet that generates a magnetic force;

a magnetic gap that causes the magnetic force to act;

a yoke that is provided to be partially opposed to the magnet and forms a magnetic circuit that guides the magnetic force of the magnet to the magnetic gap;

a coil bobbin that is formed in a tubular shape and is set to be axially vibratable with respect to the magnet and the yoke;

a coil that is wound around the coil bobbin and partially placed in the magnetic gap;

a cone that is vibrated in accordance with vibration of the coil bobbin;

an edge that retains the cone at almost a center; and a frame that fixes each of the edge and the yoke, wherein the magnetic gap has a magnetic fluid with a viscosity selected so as to (i) provide a mechanical resonance sharpness of the speaker unit within a predetermined range having a lower value of at least 0.5 and an upper value of no more than 0.6 and (ii) center the coil bobbin so as to eliminate a need for a damper such that the speaker unit does not include the damper, and sound proportional to a current is output by current drive.

2. The speaker unit according to claim 1, in which the speaker unit is configured as a full range unit for an entire frequency band or a woofer for a low frequency band.

3. The speaker unit according to claim 1, wherein the magnetic fluid is a material containing an oxide iron in a synthetic ester.

4. The speaker unit according to claim 1, in which the coil is operated with the current drive such that a value of comprehensive resonance sharpness is substantially equal to a value of the mechanical resonance sharpness.

5. A current driven speaker unit comprising:

a magnet to generate a magnetic force;

a yoke arranged to be partially opposed to the magnet and configured to guide the magnetic force of the magnet to a magnetic gap;

a coil bobbin formed in a tubular shape and arranged to be axially vibratable with respect to the magnet and the yoke;

a coil wound around the coil bobbin and partially located in the magnetic gap;

a cone configured to vibrate in accordance with vibration of the coil bobbin;

an edge configured to hold the cone and to vibrate therewith; and a frame to which the edge and the yoke are attached, the magnetic gap having a magnetic fluid with a viscosity selected so as to (i) provide a mechanical resonance sharpness of the speaker unit within a predetermined range having a lower value of at least 0.5 and an upper value of no more than 0.6 and (ii) center the coil bobbin so as to eliminate a need for a damper such that the speaker unit does not include the damper, and the coil being configured to receive a driving current during operation and in response thereto to cause the coil bobbin, the cone and the edge to vibrate so as to output sound proportional to the current.

* * * * *